US011372373B2

(12) United States Patent
Denden et al.

(10) Patent No.: US 11,372,373 B2
(45) Date of Patent: Jun. 28, 2022

(54) WATCH WITH A STRIKING MECHANISM HAVING A GOVERNOR AND TIME SETTING SAFETY FUNCTION

(71) Applicant: Blancpain SA, Le Brassus (CH)

(72) Inventors: Mehdi Denden, Les Rousses (FR); Julien Peter, Gollion (CH)

(73) Assignee: Blancpain SA, Le Brassus (CH)

( * ) Notice: Subject to any disclaimer, the term of this patent is extended or adjusted under 35 U.S.C. 154(b) by 923 days.

(21) Appl. No.: 16/164,853

(22) Filed: Oct. 19, 2018

(65) Prior Publication Data

US 2019/0155220 A1 May 23, 2019

(30) Foreign Application Priority Data

Nov. 23, 2017 (EP) ..... 17203201

(51) Int. Cl.
*G04B 21/06* (2006.01)
*G04B 27/00* (2006.01)
(Continued)

(52) U.S. Cl.
CPC ..... *G04B 21/06* (2013.01); *G04B 21/10* (2013.01); *G04B 21/14* (2013.01); *G04B 23/03* (2013.01); *G04B 27/00* (2013.01)

(58) Field of Classification Search
CPC ..... G04B 21/02; G04B 21/04; G04B 21/06; G04B 21/10; G04B 21/14; G04B 27/00
See application file for complete search history.

(56) References Cited

U.S. PATENT DOCUMENTS 7,443,769 B2 * 10/2008 Goeller ..... G04B 21/12 368/269
8,000,174 B2 * 8/2011 Rochat ..... G04B 21/12 368/185
(Continued)

FOREIGN PATENT DOCUMENTS

CH 708 353 A2 1/2015
EP 1 429 214 A1 6/2004
(Continued)

OTHER PUBLICATIONS

European Search Report dated Jun. 5, 2018 in European Application 17203201.3, filed on Nov. 23, 2017 ( with English Translation of Categories of Cited Documents & Written Opinion).

*Primary Examiner* — Amy Cohen Johnson
*Assistant Examiner* — Jason M Collins
(74) *Attorney, Agent, or Firm* — Oblon, McClelland, Maier & Neustadt, L.L.P.

(57) ABSTRACT

Watch with a time setting mechanism with an uncouplable motion work lever, with a striking mechanism having a governor, including at least one control piece set in motion by a movement or on user command, and a governor mechanism arranged to regulate to a substantially constant value the rotational speed of a strike function actuator, this striking mechanism including, for at least one control piece, a governor trigger piece arranged, according to the angular position of this control piece, to operate a governor stop jumper able to block or allow the rotation of this governor mechanism, and, by means of an articulated connection, to isolate the motion work lever in an uncoupling position or place it in a coupling position.

13 Claims, 5 Drawing Sheets

(51) Int. Cl.

| | |
|---|---|
| ***G04B 21/10*** | (2006.01) |
| ***G04B 21/14*** | (2006.01) |
| ***G04B 23/03*** | (2006.01) |

(56) References Cited

U.S. PATENT DOCUMENTS

| | | | | |
|---|---|---|---|---|
| 8,873,347 | B2 * | 10/2014 | Goeller ..... | G04B 21/00<br>368/72 |
| 2008/0144449 | A1 | 6/2008 | Goeller | |

FOREIGN PATENT DOCUMENTS

| | | | |
|---|---|---|---|
| EP | 1 925 997 | A1 | 5/2008 |
| EP | 1 933 211 | A1 | 6/2008 |

* cited by examiner

WATCH WITH A STRIKING MECHANISM HAVING A GOVERNOR AND TIME SETTING SAFETY FUNCTION

CROSS-REFERENCE TO RELATED APPLICATION

This application claims priority of European Patent Application No. 17203201.3 filed on Nov. 23, 2017 the entire disclosure of which is incorporated herein by reference.

FIELD OF THE INVENTION

The invention concerns a watch with a striking mechanism with a governor, comprising a time setting control mechanism with a time setting means arranged to drive, in its coupling position, a motion-work lever capable of occupying a coupling position and an uncoupling position, a movement comprising an output for releasing the passing strike by the movement and arranged to drive at least one reference wheel set, and said striking mechanism comprising at least one control piece arranged to be set in motion by said output or on user command, and to read position information on said at least one reference wheel set, said striking mechanism further comprising a governor mechanism arranged to regulate the rotational speed of at least one striking function actuator to a substantially constant value.

The invention concerns the field of striking mechanisms for watches, timepieces or music boxes, and more particularly, the field of striking and/or alarm watches.

BACKGROUND OF THE INVENTION

Timepiece striking mechanisms are large complications, which are complex as regards not only the number and complexity of the kinematics of their components, but also their possible operating modes. Managing safety features between the various modes is always complex. For watches comprising additional complications that operate automatically, such as the grande sonnerie, managing the safety functions is even more complex.

Indeed, it is necessary not only to ensure that the various strike or alarm sounds are played properly without interference, but also to ensure normal operation of the timepiece, especially a watch, with all its other functions, including, naturally, the most classic: setting and winding.

The situation becomes complicated when the mechanisms implement high inertia components, which cannot be stopped immediately: the oscillating winding weight, governor inertia blocks, or suchlike.

The space available, particularly inside a watch, makes it impossible to place an isolator after each moving part, and the difficulty consists in ensuring the safety functions with a reduced number of components, of average complexity and having the smallest possible volume.

European Patent Application EP2498148 in the name of MONTRES BREGUET SA discloses, for a similar problem, a safety mechanism protecting against inadvertent manipulations of the minute repeater, applied to a striking mechanism comprising a striking unit or fusee, and a push-piece actuating a first minute repeater control lever, for a timepiece movement driving a release cam which, in automatic operation, pivots a release lever towards a detent ratchet of the striking unit, which, during execution of a striking function, drives a plate carrying a winding cam. This mechanism includes a safety mechanism protecting against inadvertent manipulations, and a second safety lever, whose pivoting is controlled by the first lever when the minute repeater is actuated, and which includes a notch cooperating with a pivoting bolt returned by a spring, to prevent the minute repeater being released again once set in motion, this pivoting bolt being released after the end of the minute repeater cycle.

European Patent Application No EP1429214 in the name of ROTH & GENTA discloses a timepiece with a mechanism striking the hours, quarters and minutes, comprising a movable part of the striking mechanism capable of being moved between a determined rest position and an operating position, means for releasing the striking mechanism, means for periodically moving this movable part into the operating position when the striking mechanism is released, a time setting mechanism including a winding and setting stem on which a sliding pinion is slidably mounted to move into mesh with a setting train, a pull-out piece meshed, on the one hand, with the winding stem and, on the other hand, with a setting lever meshed with the sliding pinion. means for locking the setting lever connect the latter to the movable part of the striking mechanism, so that the locking means lock the setting lever as soon as the movable part of the striking mechanism is moved away from its rest position.

SUMMARY OF THE INVENTION

The invention proposes to produce a device that prevents the time being set during execution of a passing strike function (such as a grande sonnerie or petite sonnerie), of a minute repeater function, or of an alarm function, in a simple and reliable manner, and compatible with the implementation of efficient safety mechanisms of average complexity.

The invention requires the motion work mechanism to be properly positioned before the governor is stopped, during execution of a striking function, in order to allow the user to set the time at the end of the striking function.

The invention also proposes to ensure the locking and unlocking of the striking work governor, while guaranteeing proper operation of the motion work.

To this end, the invention concerns a timepiece, especially a watch, according to claim 1.

The invention includes specific means for synchronizing and sequencing two functions, consisting, on the one hand, in releasing or locking the striking work governor, and on the other hand, in coupling or uncoupling the motion work setting mechanism.

BRIEF DESCRIPTION OF THE DRAWINGS

Other features and advantages of the invention will appear from reading the following detailed description, with reference to the annexed drawings, in which:

FIG. 1: motion work lever;

FIG. 2: intermediate motion work uncoupling lever;

FIG. 3: motion work uncoupling lever;

FIG. 4: governor release finger, in a one-piece version with a governor plate and a single comma-shaped finger;

FIG. 5: governor control cam;

FIG. 6: governor stop jumper;

FIG. 7: minute-rack;

FIG. 8: governor including a governor pinion.

FIGS. 9 and 10 represent the mechanism according to the invention in a position where the governor is locked by the governor stop jumper resting on the toothing of the governor pinion;

FIGS. 11 and 12 represent the same mechanism as the governor is being released;

FIGS. 13 and 14 represent the same mechanism in its position before the governor is locked;

DETAILED DESCRIPTION OF PREFERRED EMBODIMENTS

Figure 1:
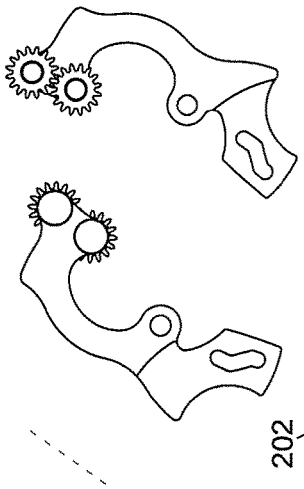
FIGS. 1 to 8 are schematic representations, each comprising two, back and front plan views and one perspective view of the main components of the mechanism according to the invention.
Figure 2:
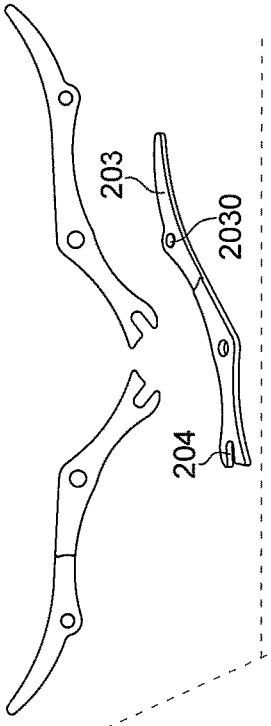
Figure 8:
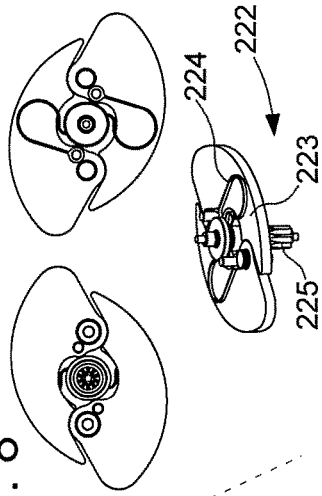
Figure 3:
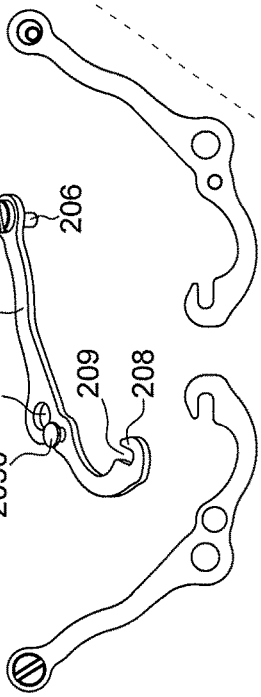
Figure 5:
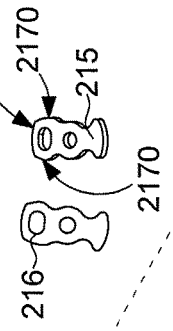
Figure 6:
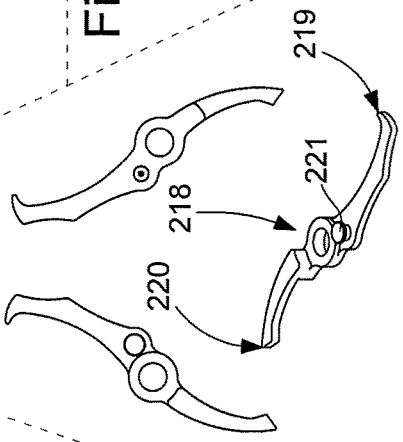
Figure 4:
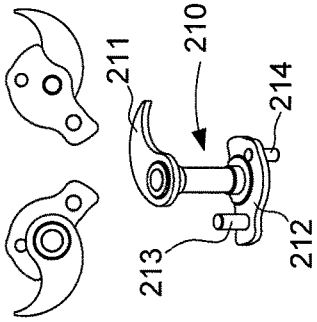
Figure 7:
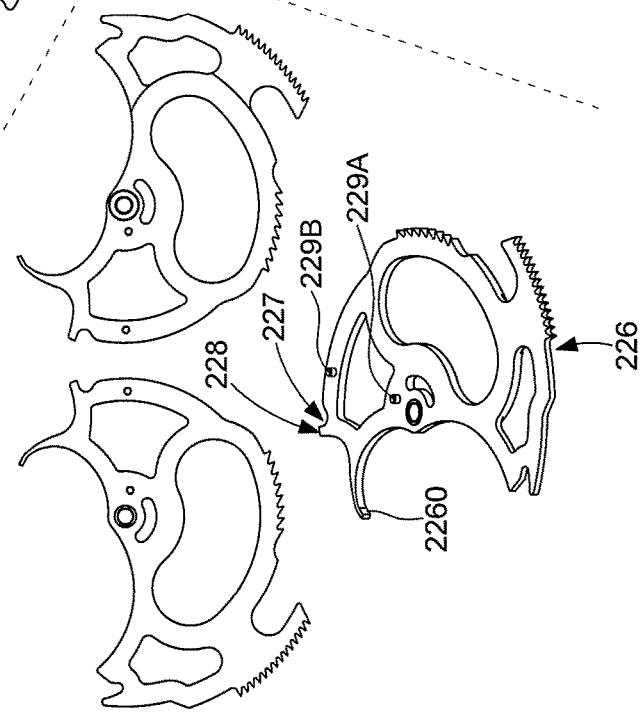

The invention concerns a watch 1000 with at least one striking mechanism 100 having a governor.

A "striking mechanism" is used here in the broad sense to mean a sound emitting timepiece mechanism: a passing strike, repeater, alarm or timer, automate, music box or otherwise.

This watch 1000 includes a time setting control mechanism, especially but not necessarily of a conventional type using a winding and setting control stem, with a setting means 200, particularly a sliding pinion, which is arranged to drive, in its coupling position, a motion work lever 201, able to occupy a coupling position and an uncoupling position.

Watch 1000 includes at least one movement 2000, comprising an output 3 for releasing the passing strike by the movement, which is arranged to drive at least one reference wheel set 1, such as a snail or suchlike. Striking mechanism 100 includes at least one control piece 226, such as an hour rack, quarter rack, minute rack or similar, arranged to be set in motion by output 3, or on user command, and to read position information on said at least one reference wheel set 1.

The invention concerns a watch 1000 or a timepiece 2000 including at least one specific striking mechanism 100. This timepiece 2000 may be a music box or include a music box.

The work by François LECOULTRE entitled *Les montres compliquées* (A Guide to Complicated Watches), Editions Horlogères, Bienne (Switzerland), 1985, ISBN 2-88175-000-1, explains, in detail, the basic mechanisms forming striking mechanisms, at pages 97 to 205 (pages 85 to 181 of the English edition), in different chapters:

repeating watches,
old repeating watches,
modern quarter-repeater,
simplified repeater,
half-quarter repeater,
Breguet half-quarter repeater,
five minute-repeater,
minute-repeaters
clock watches Unless necessary, these basic mechanisms will not be discussed here in detail, since striking mechanism specialists will know how to find the composition of such mechanisms in this universal reference work, in particular in the aforementioned last two chapters.

Striking mechanism 100 further includes a governor mechanism 222, especially of the centrifugal and/or eddy current type, arranged to regulate to a substantially constant value the rotational speed of at least one striking mechanism or alarm actuator.

According to the invention, said striking mechanism 100 includes, for at least one control piece 226, a governor trigger piece 210 which is arranged, depending on the kinematics of said control piece 226 (angular position, movement, and direction of pivoting), to operate a governor stop jumper 218. This governor stop jumper 218 is designed to be capable of locking or allowing rotation of governor mechanism 222.

Governor trigger piece 210 includes means, which, in the non-limiting variant illustrated by the Figures, are a release plate 212 and a finger 211, and which are arranged, by means of an articulated connection, to isolate motion work lever 201 in the uncoupling position or place it in the coupling position.

In a particular, non-limiting embodiment, illustrated by the Figures, at least one control piece 226, which is associated with a governor trigger piece 210, includes a drive means 227, which is arranged, in certain positions, to lift or drive such a finger 211 comprised in governor trigger piece 210 associated with said control piece when governor 222 is released.

Drive means 227 may take various forms, for example as in the Figures, a recess delimited by an edge 228, or which may be a protrusion, a finger, a feeler arm, a cam, or a toothing or otherwise, for cooperating with said finger 211. Drive means 227 is arranged to lift finger 211 when governor 222 is locked, and to pivot finger 211 during execution of a strike or alarm function. This pivoting can be achieved by pressure contact as illustrated in the Figures, or by meshing in other variants that are not illustrated.

In the variant illustrated by the Figures, at least one governor trigger piece 210 comprises such a finger 211, which is arranged to pivot coaxially to a governor control cam 215.

This governor control cam 215 is coaxial to a release plate 212 integral with a finger 211. Release plate 212 and governor control cam 215 are pivotable in a limited manner with respect to each other, with a relative amplitude that is limited by the travel of a first pin 214, comprised in release plate 212, in a first hole 216 of governor control cam 215, as illustrated in the Figures, or vice versa in another non-illustrated embodiment. The effect of this arrangement is to allow motion work lever 201 to return to its coupling position before an axial pinion 225 comprised in governor mechanism 222 is locked by a locking finger 220, comprised in governor stop jumper 218; finger 211 either pivots integrally with release plate 212, or is arranged to be driven by another finger 211 which corresponds to another control piece 226 and pivots integrally with release plate 212.

More particularly, governor stop jumper 218 comprises a feeler arm 219 which is held resting on a cam track of governor control cam 215 by a first spring 230. This cam track comprises, on its distal periphery, a cylindrical sector 217 corresponding to the free position of governor 222 and, set back from the cylindrical sector, a lateral edge 2170 corresponding to the locked position of governor 222 which is then held by the restoring torque of first spring 230.

In a particular variant, corresponding in particular to the case illustrated by the Figures, striking mechanism 100 comprises several control pieces 226, operating in cascade, and one of which is the last to be manoeuvred by the others, and there is only one finger 211, which pivots integrally with release plate 212 and is arranged to cooperate with the last control piece 226. In the particular case of the Figures, this last control piece 226 is a minute rack, connected in a conventional manner to a quarter rack, which is not represented so as not to overload the Figures, striking mechanism 100 also including an hour rack; the single finger 211, pivoting integrally with release plate 212 is then arranged to cooperate with the minute rack.

Each reference wheel set 1 is usually a snail, on which the corresponding control piece 226 will look for information when it falls. It is understood that, because the snails are off-centre, and any action of the motion work moves the snails, the motion work must necessarily be uncoupled during execution of any strike function.

In another non-illustrated variant, striking mechanism 100 includes several control pieces 226, each arranged to cooperate with a distinct finger 211. A specific finger 211 of a governor trigger piece 210 thus corresponds to each control piece 226, which is either specific to the control piece 226 concerned, or common to all the control pieces 226. More particularly, the various fingers 211 have a limited angular amplitude with respect to each other, and only one finger 211 pivots integrally with release plate 212.

In another non-illustrated variant, governor trigger piece 210 is common to all the control pieces 226 and carries all the fingers 211 specific to each of control pieces 226.

Via its finger 211 and release plate 212, governor trigger piece 210 is arranged, through an articulated connection, to isolate motion work lever 201 in the uncoupling position or to place it in the coupling position. This articulated connection includes, for at least one governor trigger piece 210, in particular for each governor trigger piece 210, at least one motion work uncoupling lever 205. This motion work uncoupling lever 205 is articulated by a groove 209 comprised therein on a second pin 213 comprised in governor trigger piece 210, or vice versa, and motion work uncoupling lever 205 is subjected to the restoring torque of a second spring 231, and is arranged to control, directly or indirectly, the switching of motion work lever 201 between its coupling position and its uncoupling position or vice versa, depending on the angular position of governor trigger piece 210.

Advantageously, motion work uncoupling lever 205 is articulated with an intermediate motion work uncoupling lever 203, which is articulated with motion work lever 201, and includes a pin 2030 sliding inside a second oblong hole 202 comprised in motion work lever 201. The stop position 2028 farthest from setting means 200 corresponds to the released position of governor mechanism 222, and the stop position 202A closest to setting means 200 corresponds to the locked position of governor mechanism 222. The pivot point of intermediate motion work uncoupling lever 203 is located between pin 2030 and the articulation with motion work uncoupling lever 205. Motion work lever 201 includes two intermediate wheels which are substantially aligned on its axis of pivoting, the farthest wheel is arranged to mesh with setting means 200, formed in the variant of the Figures by a sliding pinion, and the closest wheel meshes with the motion work. The second oblong hole 202 includes substantially circular arcs at its two ends, which are substantially centred, in a median position of the limited angular travel of motion work lever 201, on the axis of pivoting of intermediate motion work uncoupling lever 203, said arcs are joined by a substantially linear section, the second oblong hole 202 thus has an S shape which forces motion work lever 201 to pivot during the movements of pin 2030. This S shape makes it possible to place the following actions in sequence: unlocking the governor then uncoupling the motion work, and especially re-coupling the motion work before locking the governor. Uncoupling the motion work requires moving pin 2030 to the bottom of oblong hole 202.

Figure 21:
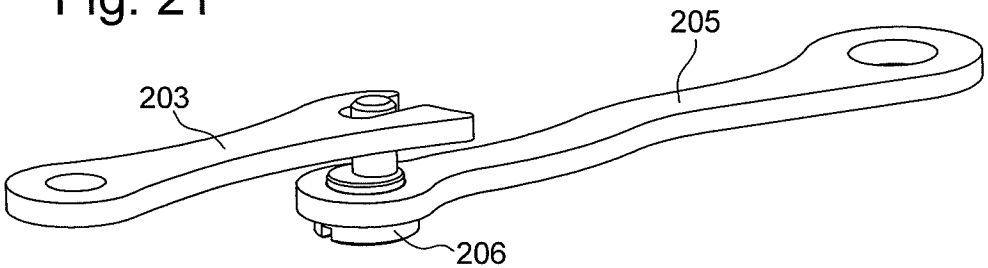
FIG. 21 is another detail of FIG. 12, showing a perspective view of the articulated connection between the motion work uncoupling lever of FIG. 3 and the intermediate motion work uncoupling lever of FIG. 2, with a cam carried by the motion work uncoupling lever for adjusting the duration between the coupling of the motion work lever with the time setting means of the timepiece movement on the one hand, and the locking of the governor mechanism on the other hand.

In a particular variant illustrated in the Figures and especially FIG. 21, the articulated connection between motion work uncoupling lever 205 and intermediate motion work uncoupling lever 203 includes a cam 206 for adjusting the duration between the coupling of motion work lever 201 to setting means 200 on the one hand, and the locking of governor mechanism 222 on the other hand.

Figure 10:
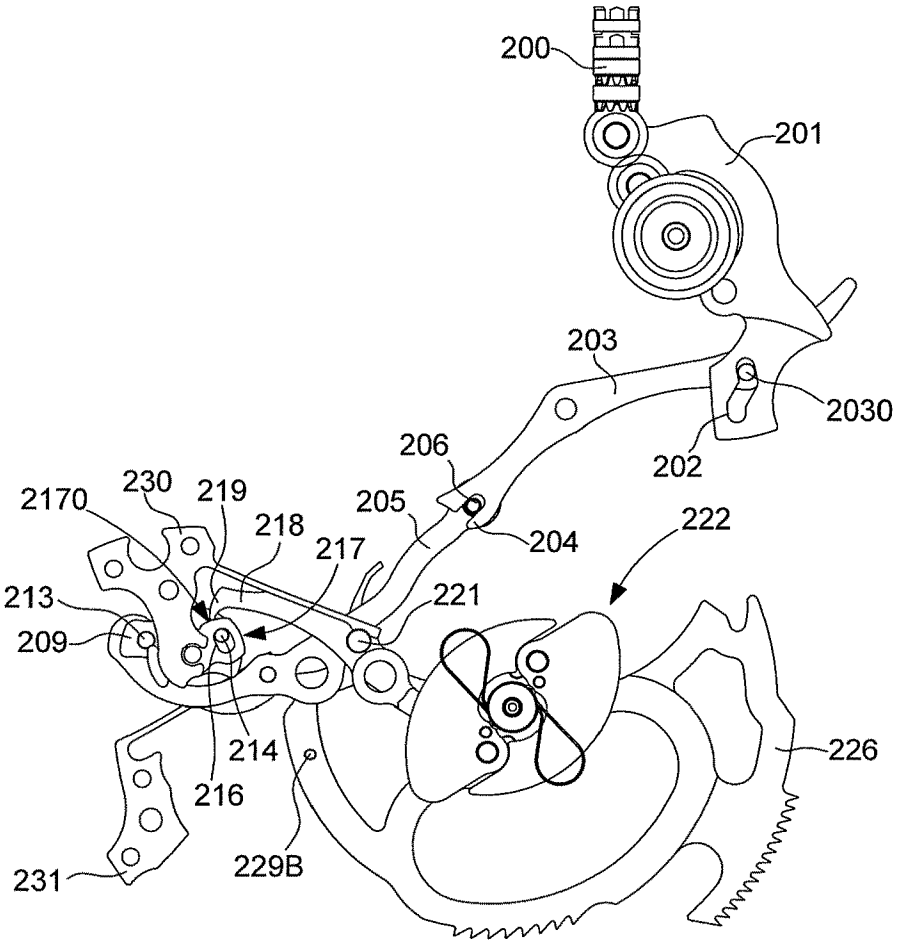
FIGS. 9 to 14 schematically represent, two-by-two and in a plan view, the striking mechanism according to the invention in the same position, the odd Figures showing the back side, and the even Figures showing the front side; not all the components are represented, only those which are essential for performing the illustrated function are visible.
Figure 9:
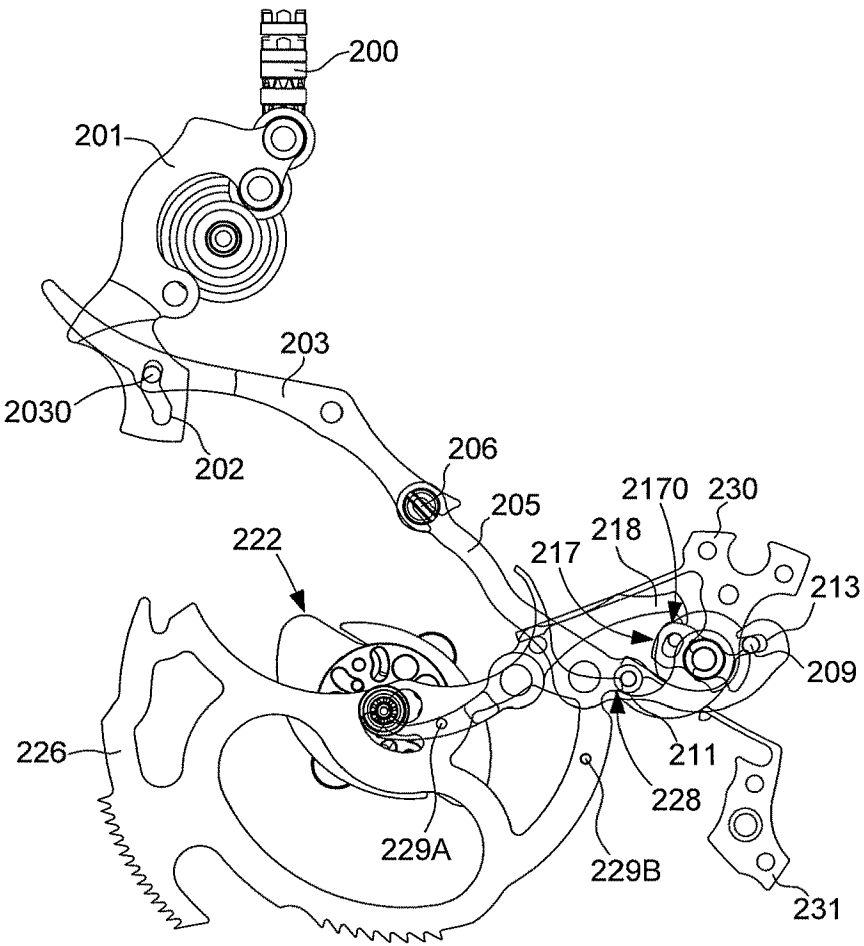
Figure 17:
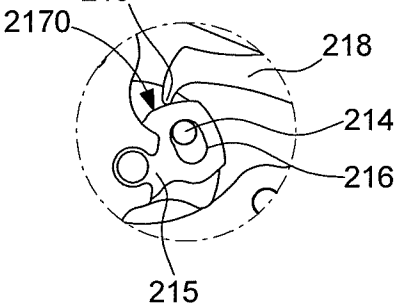
FIG. 17 is another detail of FIG. 10, showing the interaction between, on the one hand a pin comprised in the release plate of FIG. 4 in a first hole comprised in the governor control cam of FIG. 5, and on the other hand, a feeler arm comprised in the governor stop jumper of FIG. 6, at the end thereof opposite to that of the finger of FIG. 15, with a lateral edge comprised in the cam track of the governor control cam of FIG. 5.
Figure 16:
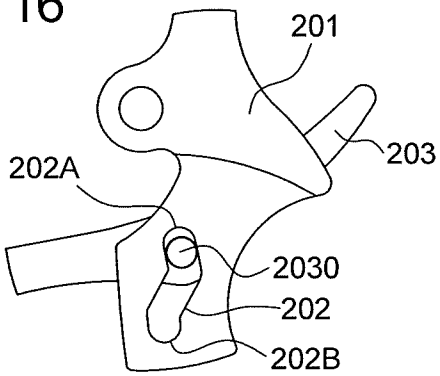
FIG. 16 is a detail of FIG. 10, showing the interaction between a pin carried by the intermediate motion work uncoupling lever of FIG. 2 and a first, upper end of an oblong hole comprised in the motion work lever of FIG. 1.
Figure 15:
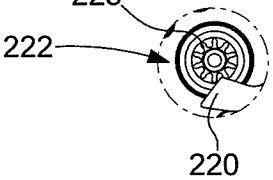
FIG. 15 is a detail of FIG. 9, showing a locking finger at the end of the governor stop jumper of FIG. 6 resting on the toothing of the governor pinion.

FIGS. 9 and 10 show the locked governor. Finger 211 of governor trigger piece 210 is stopped on edge 228 of minute rack 226. As seen in FIG. 17, feeler arm 219 of governor stop jumper 218 is on the side of governor control cam 215, on edge 2170, and is thus in its position closest to the axiscommon to governor control cam 215 and to governor trigger piece 210. The first spring 230 bears on pin 221 of governor stop jumper 218 and pushes control finger 220 to the bottom of the toothing of governor pinion 225, to immobilise governor 222 in rotation, as can be seen in FIG. 15. As can be seen in FIG. 17, lower pin 214 of governor trigger piece 210 is in a stop position in the first oblong hole 216 of governor control cam 215, against a first end, which, in the variant illustrated by the Figures, is on the opposite side to minute rack 226. Upper pin 213 cooperates with groove 209 of hook 208 of motion work uncoupling lever 205, in the position of said upper pin 213 farthest from second spring 231, which is resting on pin 2050, and tends to move away from minute rack 226 the articulation with intermediate motion work uncoupling lever 203 which, in the position of FIGS. 9 and 10, is closest to said minute rack 226. This articulation does not then impede the pivoting of intermediate motion work uncoupling lever 203, in the illustrated position where pin 2030 of the latter can occupy the upper end of hole 202 of motion work lever 201, which can thus occupy the position shown, wherein one of these pinions meshes with setting means 200, which allows operation of the time setting mechanism. FIG. 16 shows the interaction between a pin 2030 carried by intermediate motion work uncoupling lever 203 and a first, upper end 202A of an oblong hole 202, comprised in motion work lever 201, said pin 2030 is not, however, stopped at the bottom of said hole 202.

Figure 12:
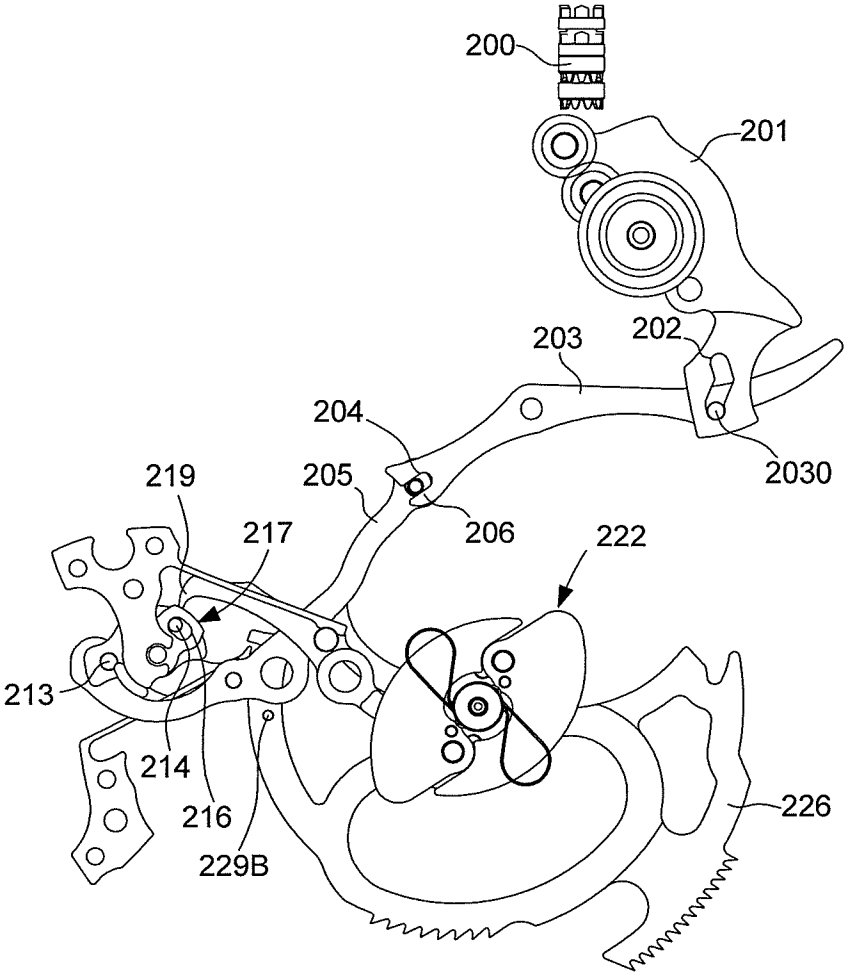
Figure 11:
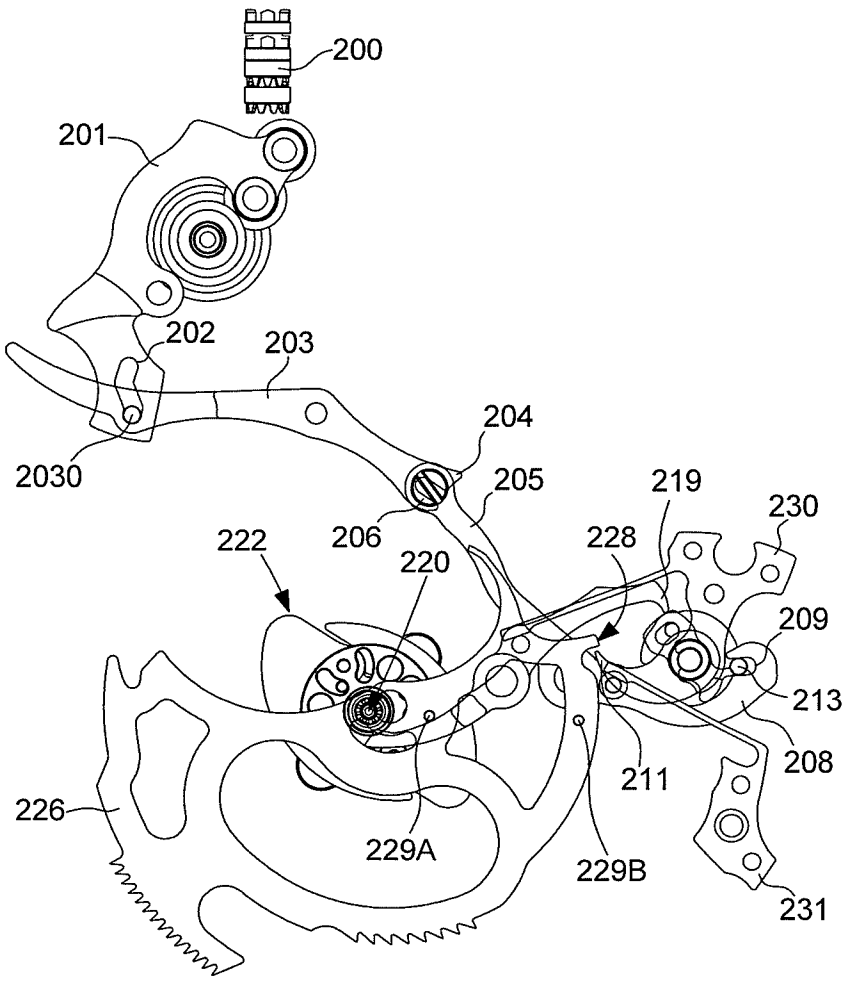
Figure 20:
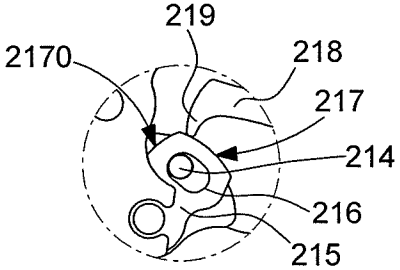
FIG. 20, which is similar to FIG. 17, is another detail of FIG. 12 showing, on the one hand, the same interaction between the first pin of the release plate and the first hole of the governor control cam pin of FIG. 5, and, on the other hand, the interaction between the feeler arm of the governor stop jumper with a cylindrical sector of the cam track of the governor control cam.
Figure 22:
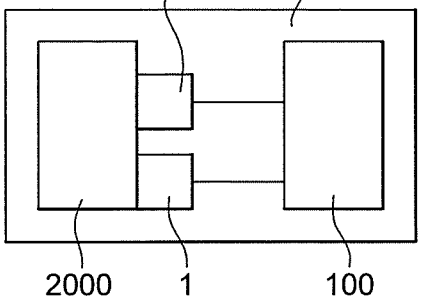
FIG. 22 is a block diagram which represents a watch comprising a striking mechanism according to the invention.
Figure 19:
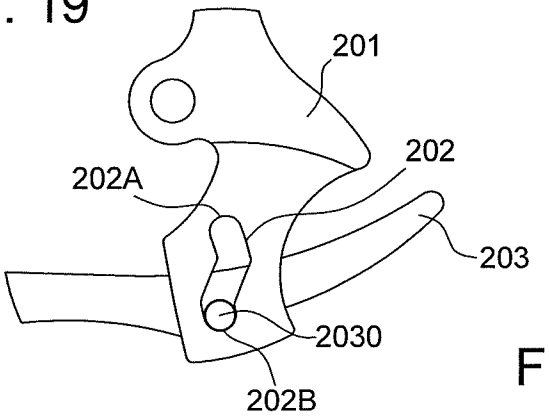
FIG. 19, which is similar to FIG. 16, is a detail of FIG. 12 showing the interaction between the pin of the motion work intermediate uncoupling lever with the opposite, lower end of the oblong hole of the motion work lever.
Figure 18:
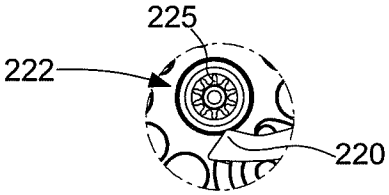
FIG. 18, which is similar to FIG. 15, is a detail of FIG. 11, showing the release of the governor stop jumper locking finger from the governor pinion toothing.

FIGS. 11 and 12 shows the released governor, when a striking cycle is started. Finger 211 of governor trigger piece 210 is not resting on edge 228 of minute rack 226 but is free inside groove 227 of the latter. As can be seen in FIG. 20, feeler arm 219 of governor stop jumper 218 is on cylindrical portion 217 of governor control cam 215, and is therefore in its position farthest from the axis common to governor control cam 215 and to governor trigger piece 210, rendering ineffective the restoring torque of first spring 230, which cannot push control finger 220 to the bottom of the toothing of governor pinion 225, and cannot impede the rotation of governor 222, as seen in FIG. 18. FIG. 20 shows the lifting of the feeler arm by means of the cam: lower pin 214 of governor trigger piece 210 leaves its stop position of FIG. 17, this lower pin 214 is now no longer stopped inside first oblong hole 216, it is not driving anything, and is able to move, during the striking function, in an angular travel that will allow re-coupling of the motion work. Upper pin 213 cooperates with groove 209 of hook 208 of motion work uncoupling lever 205, this time in the position of said upper pin 213 closest to second spring 231, and the articulation with intermediate motion work uncoupling lever 203 is farthest from minute rack 226. This articulation forces intermediate motion work uncoupling lever 203 to pivot into the position illustrated in FIG. 19 where pin 2030 is closest to minute rack 226 and abuts on lower end 202B of hole 202 of motion work lever 201, which is then disengaged from setting means 200, especially a sliding pinion, which prevents operation of the time setting mechanism.

Figure 14:
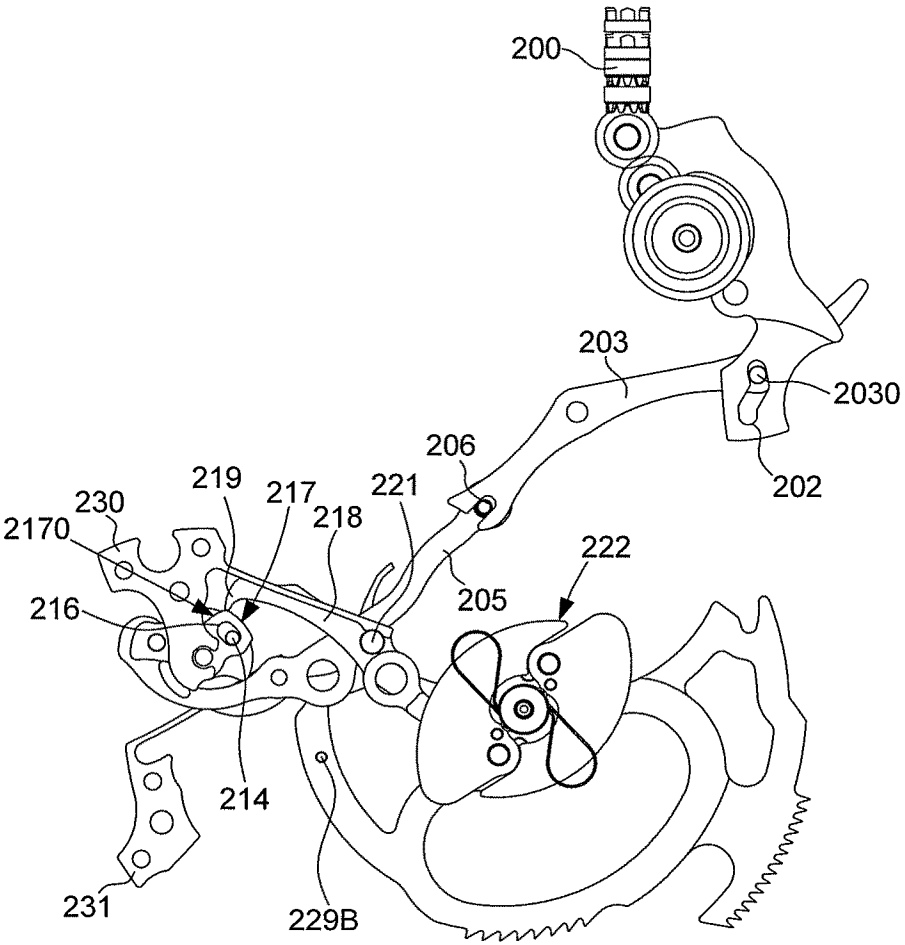
Figure 13:
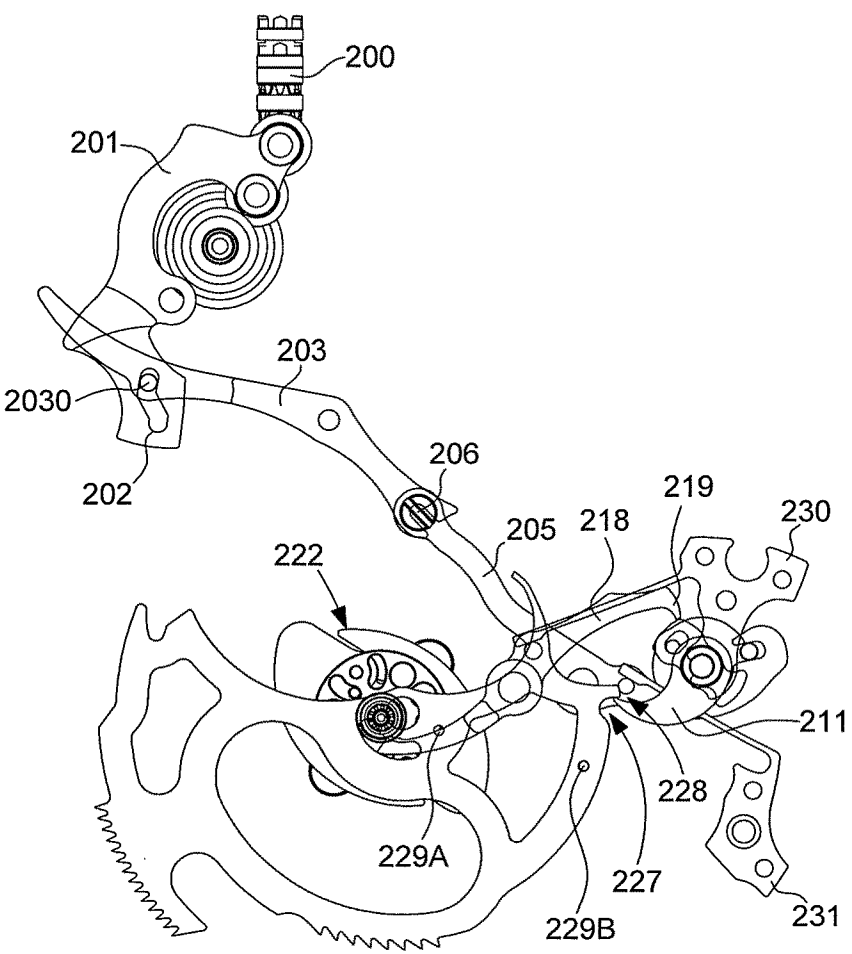

FIGS. 13 and 14 show the mechanism at the instant preceding locking of the governor, at the end of a striking cycle. The return of minute rack 226 re-hooks finger 211, and shifts lower pin 213 of governor trigger piece 210, which after its movement inside first oblong hole 216, is stopped on a second end, which, in the variant illustrated in the Figures, is on the side of the minute rack. Feeler arm 219 of governor stop jumper 218 reaches an unstable point of equilibrium on the edge of cam 215, between cylindrical portion 217 and edge 2170, just before abruptly tipping and returning to the position of FIGS. 9 and 10. In these last moments, the motion work is coupled again, and then the governor is locked again. The motion work is correctly positioned before the governor stops, indeed, otherwise the user can no longer set the time; this action is precisely adjusted by means of cam 206 which determines the end of strike synchronization and ensures that the motion work is coupled again before the governor stops.

Manual adjustment of cam 206 makes it possible to finely adjust these two moments, more easily than an adjustment of the beak of finger 211, whose position, in relation to that of minute rack 226, actually determines the start and end of the release function.

In short, the invention includes an intermediate part, which allows control piece 226 to release the governor and uncouple the motion work simultaneously, and which is more particularly formed by governor trigger piece 210, which is distinct from control piece 226. This governor trigger piece 210 is actuated by control piece 226 and makes possible the ON/OFF governor function, and the motion work coupling/uncoupling function.

Indeed, when a striking work is released, automatically or on manual command, control piece 226 is released. When it falls, governor trigger piece 210 pivots clockwise, according to FIG. 9, by the action of spring 231 which acts on motion work uncoupling lever 205 and thus on plate 212 which carries pin 213 and which is integral with finger 211. In pivoting, motion work uncoupling lever 205 drives motion work lever 201. Further, during this fall, governor control cam 215 is driven clockwise in FIG. 9. Governor stop jumper 218 follows the lateral shape 2170 of cam 215 up to concentric shape 217. At that moment, jumper 218 is in the high position and the governor is free. It is thus understood that when a striking function is released, the governor is released at the same time that the motion work is uncoupled.

After striking the hours, the quarters and, depending on the strike mode, the minutes, control piece 226 pivots counter-clockwise, in FIG. 13, driving finger 211 and thereby plate 212 which carries pins 213 and 214, by the end of its travel Pin 214 moves inside an oblong hole 216 of cam 215, without driving any elements of the governor stop system, whereas pin 213 will act on the motion work uncoupling levers allowing the motion work to be coupled again before the governor has stopped. After coupling the motion work again, cam 215 rotates counter-clockwise until jumper 218 reaches a position of equilibrium on side 217 of the cam. At that moment, spring 230 acting on jumper 218 abruptly shifts the cam counter-clockwise allowing it to fall instantaneously and block the strike train by acting on the governor pinion.

By way of reminder, the governor regulates the rotational speed of the control piece. If the governor stopped before the motion work was coupled again, the user would no longer be able to set the time of his watch (control piece stopped) and would have to return it to after sales service. Cam 206 makes it possible to control synchronization of the coupling of the motion work and the stopping of the governor. It is thus clear that the stopping of the governor occurs instantaneously and sequentially with the coupling of the motion work.

The invention ensures that the mechanisms are protected by avoiding any interference or collision between components, with great simplicity of use, requiring few precautions on the part of the user who is not always aware of which manoeuvres to avoid. The invention also allows for fine adjustment, by the cam mechanism, of the time delay between the locking of the governor and the coupling of the motion work.

Thus, the motion work is correctly positioned before the governor is stopped, during execution of a strike function.

The operation of the invention is fully automated by the movement.

The invention claimed is:

1. A watch with a striking mechanism having a governor, comprising a time setting mechanism with a setting means arranged to drive, in its coupling position, a motion work lever able to occupy a coupling position and an uncoupling position, a movement comprising an output for releasing the passing strike by the movement and arranged to drive at least one reference wheel set, and said striking mechanism comprising at least one control piece arranged to be set in motion by said output or on user command, and to read position information on said at least one reference wheel set, said striking mechanism further comprising a governor mechanism arranged to regulate the rotational speed of at least one striking function actuator to a substantially constant value, wherein said striking mechanism comprises, for at least one said control piece, a governor trigger piece, which is distinct from said control piece and arranged, according to the kinematics of said control piece, to operate a governor stop jumper able to block or allow the rotation of said governor mechanism, and, by means of an articulated connection, to isolate said motion work lever in said uncoupling position or place it in said coupling position, said governor trigger piece forming an intermediate part arranged to allow said control piece to simultaneously release said governor mechanism and uncouple said motion work lever.

2. The watch according to claim 1, wherein at least one said control piece which is associated with a said governor trigger piece, includes a drive means arranged to cooperate with a finger comprised in said governor trigger piece associated with said control piece when said governor is released, said drive means comprising an edge arranged to lift said finger, when said governor is locked, and to pivot said finger during execution of a strike or alarm function.

3. The watch according to claim 2, wherein one said finger is arranged to pivot coaxially to a governor control cam, coaxially to a release plate which is pivotable with respect to said governor control cam with a relative amplitude limited by the travel of a first pin, comprised in said release plate, inside a first hole comprised in said governor control cam, or vice versa, to allow said motion work lever to return to its said coupling position before the locking of a pinion comprised in said governor mechanism by a locking finger comprised in said governor stop jumper, said governor trigger piece finger either pivoting integrally with said release plate or being arranged to be driven by another said finger corresponding to another control piece and which pivots integrally with said release plate.

4. The watch according to claim 3, wherein said governor stop jumper includes a feeler arm which is held resting on a cam track comprised in said governor control cam, by a first spring, said cam track comprises, on its distal periphery, a cylindrical sector corresponding to the free position of said governor and, set back from said cylindrical sector, a lateral edge corresponding to the locked position of said governor which is then held by the restoring torque of said first spring.

5. The watch according to claim 4, wherein said striking mechanism includes several said control pieces operating in cascade, and one of which is the last to be manoeuvred by the others, and in that there is only one said finger, which pivots integrally with said release plate and is arranged to cooperate with said last one of said control pieces.

6. The watch according to claim 5, wherein said last one of said control pieces is a minute rack arranged to be driven by a quarter piece, and in that said single finger, which pivots integrally with said release plate, is arranged to cooperate with said minute rack.

7. The watch according to claim 3, wherein said striking mechanism includes several said control pieces operating in cascade, and one of which is the last to be manoeuvred by the others, and in that there is only one said finger, which pivots integrally with said release plate and is arranged to cooperate with said last one of said control pieces.

8. The watch according to claim 7, wherein said last one of said control pieces is a minute rack arranged to be driven by a quarter piece, and in that said single finger, which pivots integrally with said release plate, is arranged to cooperate with said minute rack.

9. The watch according to claim 2, wherein said striking mechanism includes several said control pieces each arranged to cooperate with a distinct said finger wherein a specific finger of a said governor trigger piece thus corresponds to each said control piece, which is either specific to said control piece concerned, or common to all said control pieces.

10. The watch according to claim 1, wherein said articulated connection includes, for each said governor trigger piece, at least one motion work uncoupling lever articulated by means of a groove comprised therein on a second pin comprised in said governor trigger piece, or vice versa, and which is subjected to the restoring torque of a second spring, and which is arranged to control, directly or indirectly, the switching of said motion work lever between its coupling position and its uncoupling position or vice versa, depending on the angular position of said governor trigger piece.

11. The watch according to claim 10, wherein said motion work uncoupling lever is articulated with an intermediate motion work uncoupling lever which is articulated with said motion work lever, and comprises a pin sliding in a second oblong hole comprised in said motion work lever, a first stop position of said time setting means corresponding to the released position of said governor mechanism, and a second stop position of said time setting means corresponding to the locked position of said governor mechanism.

12. The watch according to claim 11, wherein the articulated connection between said motion work uncoupling lever and said intermediate motion work uncoupling lever includes a cam for adjusting the duration between the moment of coupling of said motion work lever to said setting means on the one hand, and the moment of locking of said governor mechanism on the other hand.

13. The watch according to claim 1, wherein at least one said reference wheel set is a snail.

* * * * *